US007131382B2

(12) United States Patent
Gordon

(10) Patent No.: US 7,131,382 B2
(45) Date of Patent: Nov. 7, 2006

(54) WOODEN TRACK ROLLER COASTER HAVING A PASSENGER CARRIER WITH SUSPENDED SEATS

(76) Inventor: Jonathan I. Gordon, 65 Woods End Rd., Stamford, CT (US) 06905

( * ) Notice: Subject to any disclaimer, the term of this patent is extended or adjusted under 35 U.S.C. 154(b) by 0 days.

(21) Appl. No.: 10/865,053

(22) Filed: Jun. 10, 2004

(65) Prior Publication Data

US 2005/0274275 A1 Dec. 15, 2005

(51) Int. Cl.
*A63G 1/00* (2006.01)

(52) U.S. Cl. ..... 104/53

(58) Field of Classification Search ..... 104/53, 104/63, 64, 89, 95

See application file for complete search history.

(56) References Cited

U.S. PATENT DOCUMENTS

| | | | | | |
|---|---|---|---|---|---|
| 699,960 | A * | 5/1902 | Lachase | ..... | 104/63 |
| 850,136 | A * | 4/1907 | Cole | ..... | 104/63 |
| 1,621,337 | A * | 3/1927 | Schmeck | ..... | 104/248 |
| 1,741,286 | A * | 12/1929 | Church | ..... | 104/63 |
| 1,881,151 | A * | 10/1932 | Traver | ..... | 104/53 |
| 4,170,943 | A | 10/1979 | Achrekar | ..... | 104/56 |
| 5,272,984 | A * | 12/1993 | Bolliger et al. | ..... | 104/63 |
| 6,550,393 | B1 | 4/2003 | Stengel | ..... | 104/124 |

OTHER PUBLICATIONS

Great Coasters International Inc. (www.greatcoasters.com) Jul. 31, 2003.*

* cited by examiner

*Primary Examiner*—S. Joseph Morano
*Assistant Examiner*—Robert J. McCarry, Jr.
(74) *Attorney, Agent, or Firm*—Gordon & Jacobson, P.C.

(57) ABSTRACT

An amusement ride has a wooden running track realized by two wooden track structures and a support beam that is disposed above the two wooden track structures and that bridges the two wooden track structures. A passenger carrier (e.g., coaster car or train) has a frame structure with a first set of wheels mounted thereto that are adapted to run along the first and second wooden track structures during positive-g motion in addition to at least one seat that is suspended below the first set of wheels. This suspended wooden-coaster design provides a distinctive rough, noisy out of control feeling in addition to a distinctive feeling of freedom (and risk/danger), which are enjoyed by many roller coaster enthusiasts.

30 Claims, 5 Drawing Sheets

WOODEN TRACK ROLLER COASTER HAVING A PASSENGER CARRIER WITH SUSPENDED SEATS

BACKGROUND OF THE INVENTION

1. Field of the Invention

This invention relates broadly to roller coaster amusement rides. More particularly, this invention relates to roller coaster amusement rides employing wooden running tracks.

2. State of the Art

Roller coasters have enjoyed immense popularity in the United States and elsewhere for over one hundred years. These rides often consist of a passenger carrying vehicle, or collection of vehicles joined together, which move along a track system. Historically, the track system typically comprised a pair of parallel rails which exhibit steep upward and downward gradients in elevation, and sharp left and right banking turns. Aside from supplying the passenger with a pleasing panoramic view from high elevations, the main objective of the roller coaster ride was to thrill the passenger by traversing the track at the fastest possible speed while maintaining an acceptable degree of safety. The thrill experienced by the passenger thus arose through the sensations of rapid acceleration, brought about through rapid changes in vertical and horizontal direction of movement.

Innovations in roller coaster design have sought to enhance and intensify passenger thrill by substantially increasing the speed of movement along the track system, and hence, the resulting forces of acceleration experienced by the passenger. These innovations were greatly facilitated by technological advances in materials engineering, a direct result of which enabled the construction of stronger and lighter track systems and passenger vehicles. However, attendant with ever increasing speeds of the passenger vehicles is the ever increasing risk of catastrophic failure of the ride. As a result, other innovations sought to enhance and intensify passenger thrill by incorporating increasingly complex geometries into the track system itself. Two of the more common track geometries which have thus evolved are the loop and the helix.

In parallel with the aforedescribed track system geometries, there also exist innovations in passenger vehicle configurations for enhancing and intensifying passenger thrill. These innovations typically depart from the conventional roller coaster in that the passenger vehicle no longer assumes the standard railway car configuration. For example, Achrekar (U.S. Pat. No. 4,170,943) discloses a suspended passenger vehicle configuration whereby individual passenger units are rotated and translated in a multiplanar manner as the carriage assembly proceeds along a Möbius strip, or one-half section of helical track. A more recent departure from the conventional passenger vehicle configuration is disclosed in Bolliger et al. (U.S. Pat. No. 5,272,984). The invention disclosed in Bolliger enables passengers to be suspended from a bogie moving along a horizontal track system, so that a seated passenger's head is in closer proximity to the bogie—and hence the track rails—than are the passenger's body and limbs. This configuration results in a passenger vehicle being designed so that each passenger is suspended with his legs in mid-air without a wall or a floor around him.

Early roller coasters were built on a wooden superstructure which was formed as a latticework to provide sufficient strength. The tracks were made of laminated wood covered by a metal strip that was nailed to the wooden track. More recently, some modern roller coasters have been built on steel superstructures with steel tracks and contain no wooden parts. Today all roller coasters are classified as either wooden or steel.

The tracks of a metal roller coaster include a pair of long steel tubes supported by a superstructure made out of slightly larger steel tubes and/or steel beams. The tubular steel tracks are prefabricated in large, curved segments that are welded together. With this manufacturing process, designers can realize a smoothly curving track that tilts the coaster car (and rider therein) in all directions, which makes for a distinctive smooth ride.

An exemplary metal roller coaster is shown in FIG. 1A including a pair of steel tubes 11A, 11B that are supported by a metal superstructure 13. The coaster car 15 is supported below the steel tubes 11A, 11B in an inverted manner by two groups of wheels that ride on the respective steel tubes 11A, 11B. Each group includes an upper wheel 17, a bottom wheel 19 and a side wheel 21, which are rigidly supported such that the wheels (and the car) follow the curves governed by the configuration of the ride. The passengers 23 are suspended below the steel tube track in seats 25 that are integral to the car 15. Such seats 25 enable the passenger's legs to dangle free, which provides a distinctive feeling of freedom (and risk/danger) that is also enjoyed by many roller coaster enthusiasts.

The metal roller coaster shown in FIG. 1A is commonly referred to an inverted roller coaster. Suspended metal roller coasters are similar to an inverted roller coaster, except that the passenger's feet are typically restrained such that they remain within the coaster car, and the coaster car typically has flexible mountings to the tubular rails which allow it to swing from side to side during the ride. These configurations also provide a distinctive feeling of freedom (and risk/danger) that is also enjoyed by many roller coaster enthusiasts.

In contrast to the steel tubular tracks of the metal roller coaster, the tracks of a wooden roller coaster include a flat metal strip that is bolted to a running track made of laminated wood. The tracks are braced by wooden cross-ties and diagonal support beams. The entire wooden track structure rests on a lattice of wooden or steel beams. With this design, designers can combine hills, twist and turns to realize a variety of course layouts. Typically, the wooden tracks are laid out in small pieces, thus forming joints that connect these pieces together. These joints impart a distinctive rattling sensation to the car (and the rider(s) therein) that is enjoyed by many roller coaster enthusiasts.

An exemplary wooden roller coaster is shown in FIG. 1B including a pair of running tracks 31 each consisting of eight layers of timbers each about 2 inches thick and 6 inches wide. The runner tracks 31 are affixed to cross beams 33 (one shown) typically by bolts and/or other fastening means. A flat metal strip 35, typically measuring 4 to 6 inches across, is bolted to each running track 31. The coaster car 37 is supported above the tracks 31 by a set of tractor wheels 39 that ride along the metal strip 35 during positive-g motion of the coaster car in addition to a set of side-friction wheels/rollers 37 and under-friction wheels/rollers 39 (which run under the inside edge of the running track 31) that prevent the car 37 from rising completely off the running track 31 during negative-g motion of the car. The wooden roller coaster provides a distinctive rough, noisy out of control feeling to the passenger, but fails to provide for suspension of the coaster car below the track. Thus, wooden roller coasters do not offer many of the distinct characteristics of inverted metal roller coasters that are enjoyed by many roller coaster enthusiasts.

Thus, there remains a need in the art to provide a wooden roller coaster that provides a distinctive rough, noisy out of control feeling to the passenger(s) while also providing for suspension of the coaster car below the track.

SUMMARY OF THE INVENTION

It is therefore an object of the invention to provide a wooden roller coaster track that affords a distinctive rough, noisy out of control feeling to the passenger(s) while also providing for suspension of the passenger car below the wooden track.

It is another object of the invention to provide a wooden roller coaster track and passenger car with seats that enable the passenger's legs to dangle free.

It is also an object of the invention to provide a wooden roller coaster track that affords suspension of the passenger car below the wooden track in different configurations, such as an enclosed frame-tunnel.

It is still another object of the invention to provide a wooden roller coaster track that is supported from above.

In accord with these objects, which will be discussed in detail below, an amusement ride having a wooden running track is realized by two wooden track structures and a support beam that is disposed above the two wooden track structures and bridges the two wooden track structures. A passenger carrier (e.g., coaster car) has a frame structure with a first set of wheels mounted thereto that are adapted to run along the first and second wooden track structures during positive-g motion of the passenger carrier. At least one seat is suspended from the frame structure below the first set of wheels.

It will be appreciated that this suspended wooden rail coaster design provides a distinctive rough, noisy out of control feeling in addition to a distinctive feeling of freedom (and risk/danger), which are enjoyed by many roller coaster enthusiasts.

According to one embodiment of the invention, the wooden running track structures rest on vertical support members.

According to another embodiment of the invention, the wooden running track structures are affixed to vertical support members that run parallel thereto and connect to the bridging support beam.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1B:
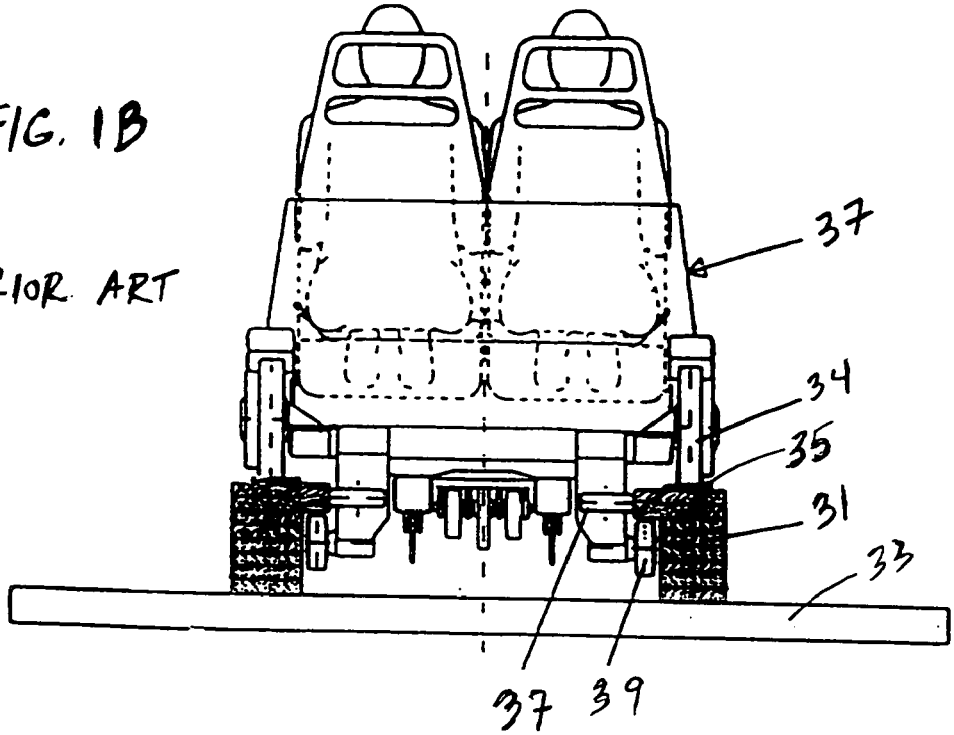
FIG. 1B PRIOR ART
FIG. 1B is a vertical section view through a prior art wooden roller coaster rail with a passenger car riding thereon.
Figure 1A:
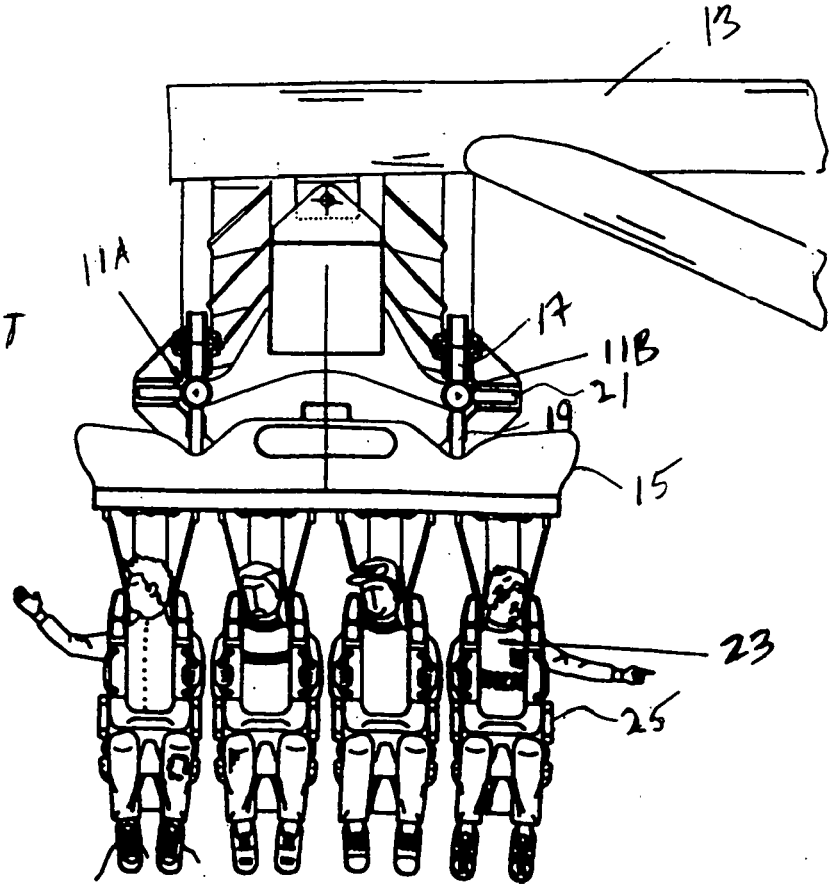
FIG. 1A PRIOR ART
FIG. 1A is vertical section view through a prior art steel roller coaster rail with a passenger car riding thereon.
Figure 2:
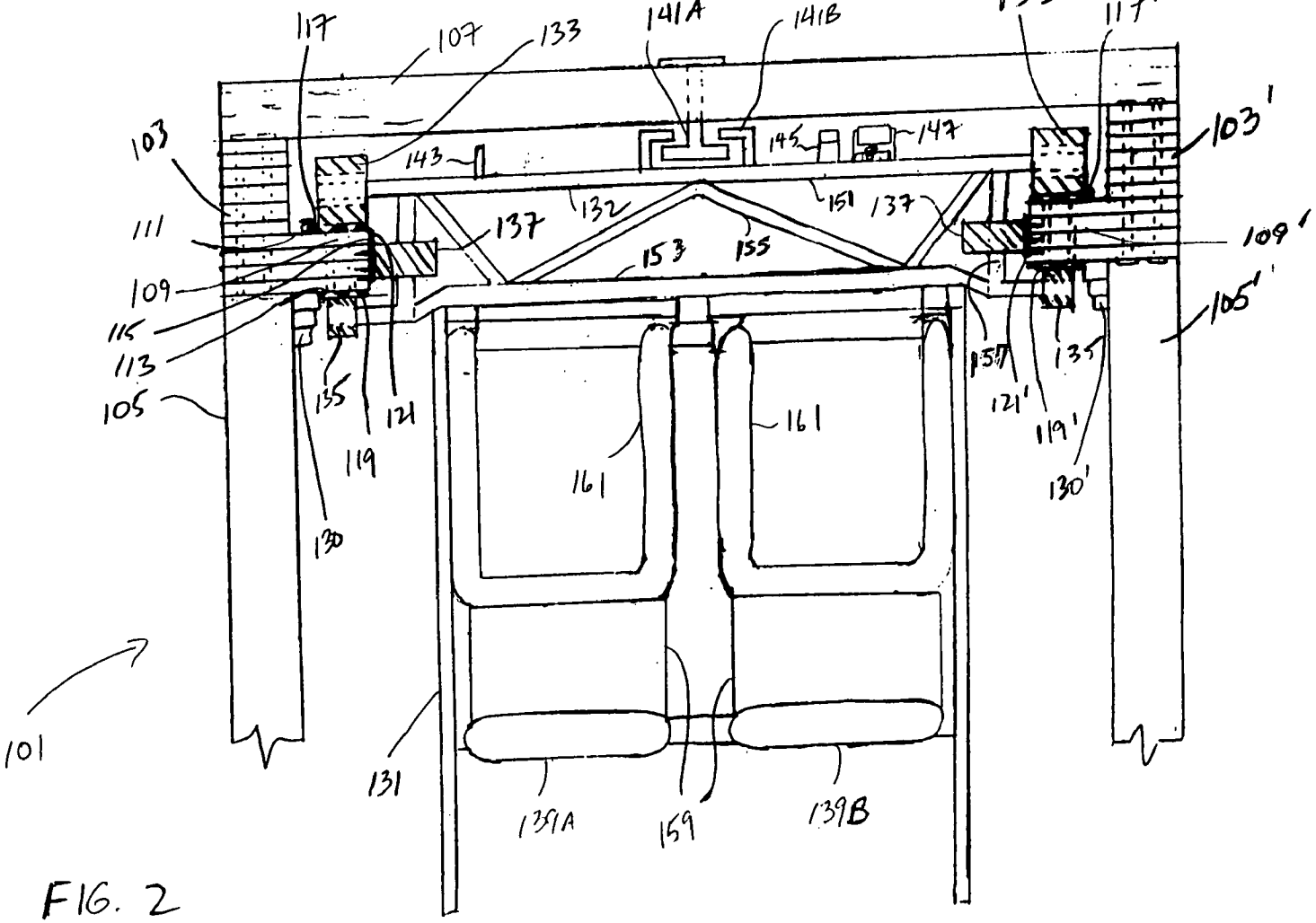
FIG. 2 is a vertical section view through a wooden roller coaster rail with a passenger car riding thereon in accordance with the present invention.
Figure 3:
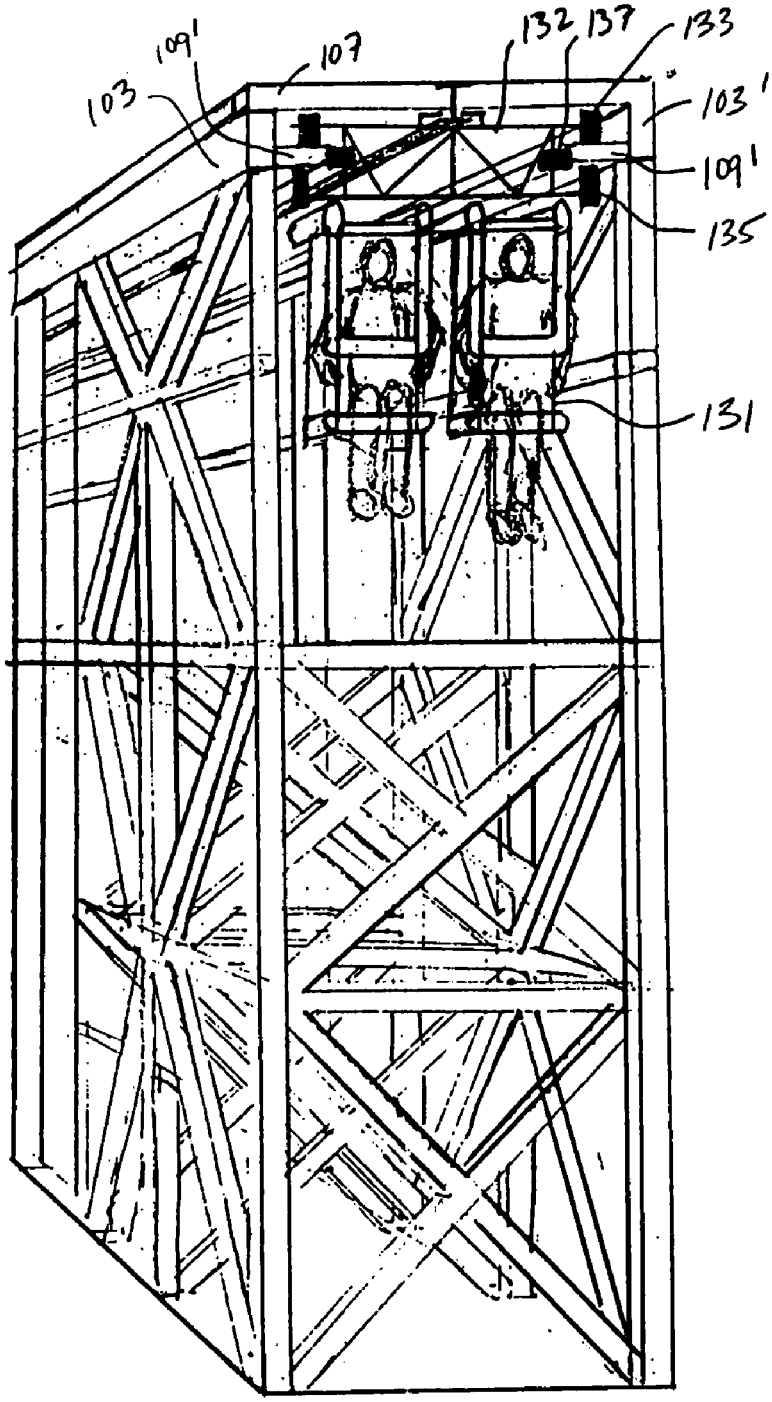
FIG. 3 is a perspective view of the wooden roller coaster rail and passenger car of FIG. 2 supported by a lattice of wooden beams.

Referring to FIG. 2, there is shown a schematic front view of a roller coaster 101 according to the present invention, including a pair of wooden running track structures 103, 103' that are supported by respective vertical support members 105, 105'. The vertical support members 105, 105' are part of a lattice of wooden or steel beams as shown in FIG. 3. A support tie 107 extends laterally from the top of the two wooden running track structures 103, 103' to bridge the two running track structures as shown. The support tie 107 may be realized by one or more wooden members, one or more steel members, or other suitable support means. Each of the running track structures 103, 103' consist of multiple layers of timbers (for example, 10 layers each about 2 inches thick) that are joined together by bolts and/or adhesive or other suitable means.

The bottom layers (for example, the bottom four layers) of the multi-layers structures 103, 103' are wider than the top layers of the structures to realize rail support portions 109, 109' that project laterally toward one another as shown. The rail support portions 109, 109' each have an upper surface 111 disposed opposite a bottom surface 113, a side surface 115. A first pair of flat metal strips or rails 117, 117', which preferably measure between 4 and 6 inches across, are bolted onto the upper surfaces 111 of the respective rail support portions 109, 109'. A second pair of flat metal strips or rails 119, 119', which preferably measure between 3 and 4 inches across, are bolted onto the bottom surfaces 113 of the respective rail support portions 109, 109'. A third pair of flat metal strips or rails 121, 121', which preferably measure between 4 and 5 inches across, are bolted onto the side surfaces 115 of the respective rail support portions 109, 109'. In order to resist deflection of the rail support portions 109, 109' downward under loading conditions, staircase supports 130, 130' (which are preferably realized by a series of narrowing-width timber sections) are affixed to the vertical support members 105, 105' adjacent the bottom surfaces of the respective rail support portions as shown, which is preferably accomplished by bolts that pass through the staircase supports 130, 130' and into the bottom surfaces of the respective rail support portions.

A coaster car 131 is supported below the running track structures 103, 103' by a frame structure 132 onto which is mounted three sets of wheels (labeled 133, 135, 137). The first set 133 rotate about a horizontal axis and ride along the metal strips/rails 117, 117' during positive-g motion of the coaster car 131. The second set 135 rotate about a horizontal axis ride along the metal strips/rails 119, 119' to prevent the car 131 from rising completely off the running track structures 103, 103' during negative-g motion of the car. The third set 137 rotate about a vertical axis and ride along the metal strips/rails 121, 121' to guide the lateral motion of the car 131. The annular rolling surfaces of the wheels 133, 135, 137 are preferably realized by a metal; however, plastic material such as nylon may also be used. The frame structure 132 preferably comprises a member 151 that extends laterally between the top wheels 133, a member 153 that generally extends laterally between the bottom wheels 137, diagonal truss members 155 therebetween, and vertical members 157 onto which are mounted the wheels of the third set 137 as shown. The frame structure 132 also rigidly supports one or more seats (two shown as 139A and 139B) under the wheels 133, 135, 137 of the car. This suspended design enable the passengers' legs to dangle free, which provides a distinctive feeling of freedom (and risk/danger) that is also enjoyed by many roller coaster enthusiasts. Because the passengers are suspended, it is necessary that they are effectively restrained in their seats. For this purpose, the seats preferably include an L-shaped shell 159 together with a hinged support harness 161 that prevents the passenger from sliding out of the seat during the ride as is well known in the art.

The support tie 107 may also support an inverted T-shaped rail 141 that cooperates with a catch enclosure 141B integral to the top of the frame structure 132 of the coaster car 131 to provide an emergency catch mechanism for the coaster car 131. The coaster car 131 may also include a brake fin 143, chain-dog 145 and anti-rollback mechanism 147 affixed to the top of the frame structure 132 above the wheels of the coaster car 131. The brake-fin 143 is surrounded and contacted by a break assembly (not shown) at one or more desired positions along the track in order to reduce the speed of the coaster car 131. The chain-dog 145 cooperates with a chain lift mechanism (not shown) that is used to pull the coaster car 121 up a lift hill. The anti-rollback mechanism 147 engages a stationary ratchet (not shown) on the lift hill in order to prevent backwards motion down the hill should the chain lift stop.

FIG. 3 illustrates a schematic front view of the roller coaster of FIG. 2 with the wooden running track structures 103, 103' resting on a lattice support structure of wooden beams. This configuration provides an elevated "frame-tunnel" that partially surrounds the passengers on all sides as shown. It is contemplated that steel beams or other suitable support structures may be used to support the wooden running track structures 103, 103' in this configuration. It is also contemplated that the track support structure may readily be adapted to provide different configurations, such as a configuration that encloses the passengers on three sides with the bottom floor level missing, a configuration that encloses the passengers on two sides with the bottom floor and one side missing, or a configuration that does not enclose the passengers with the track and supporting structures positioned above the coaster car. In these configurations, the support structure must provide height clearance for the passenger's feet at all times.

Figure 4:
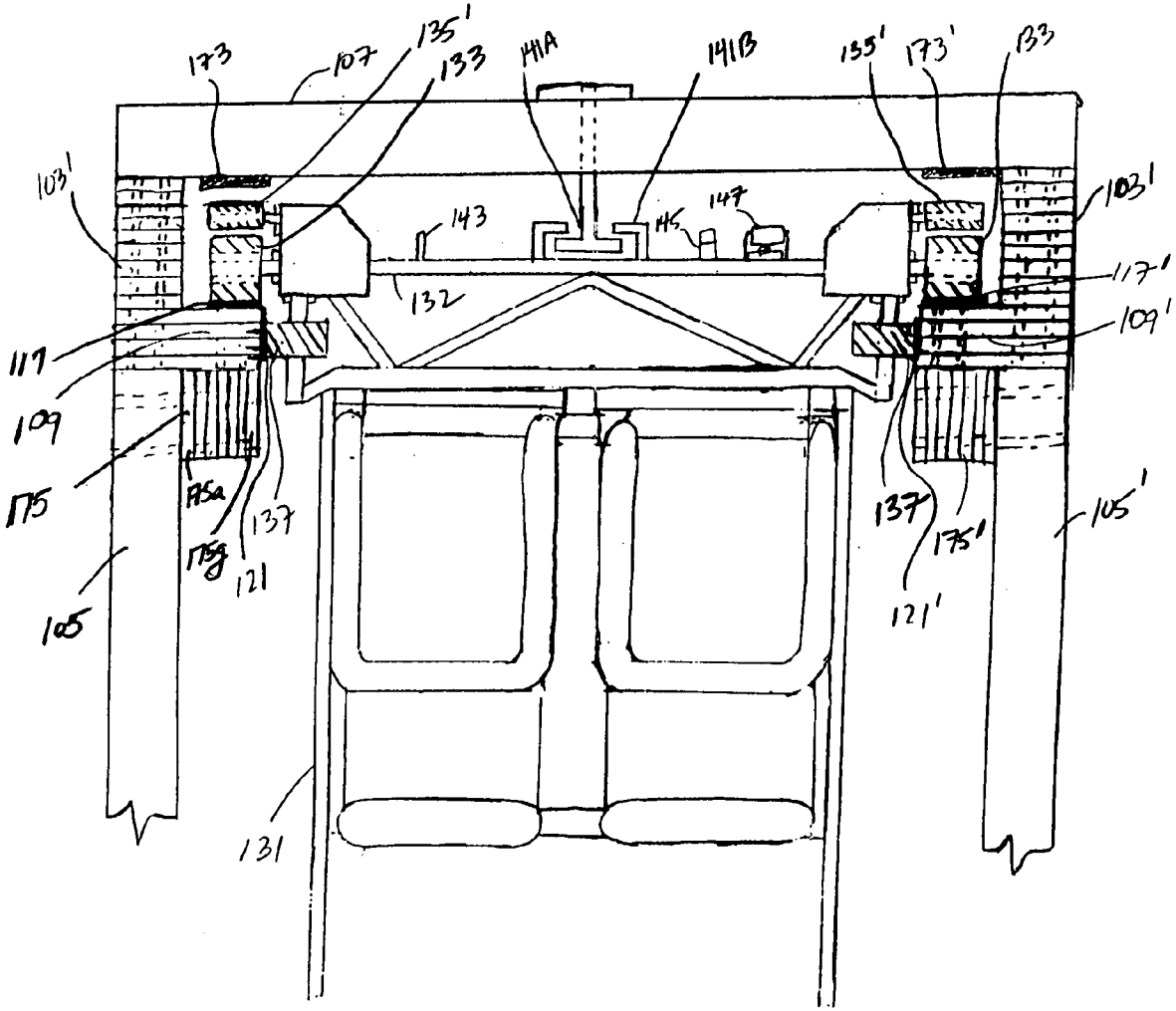
FIG. 4 is a vertical section view through a wooden roller coaster rail with a passenger car riding thereon in accordance with an alternate embodiment of the present invention.

Turning now to FIG. 4, there is shown an alternate embodiment of the present invention which is similar in many respects to the roller coaster described above with respect to FIG. 2; however, a pair of running rails 173, 173' are bolted to the underside of the support tie 107 opposite the metal strips 117, 117', and the car 131 is adapted such that a set of wheels 135' are disposed above the wheels 133. The wheels 133 rotate about a horizontal axis and ride along the metal strips 117, 117' during positive g-motion of the roller coaster car 131. During negative g-motion of the car, the wheels 135' ride on the metal strips/rails 173, 173' to prevent the car 131 from rising completely off the running track structures 103, 103'. In order to resist deflection of the rail support portions 109, 109' downward under loading conditions, supports 175, 175' (which are preferably realized by a plurality of timber sections 175*a* . . . 175*g*) extend in a longitudinal direction (which is perpendicular to the page in FIG. 4) and are affixed to the vertical support members 105, 105' adjacent the bottom surfaces of the respective rail support portions as shown, which is preferably accomplished by bolts that pass laterally through the respective supports 175/175' and the corresponding vertical support 105/105'.

Figure 5:
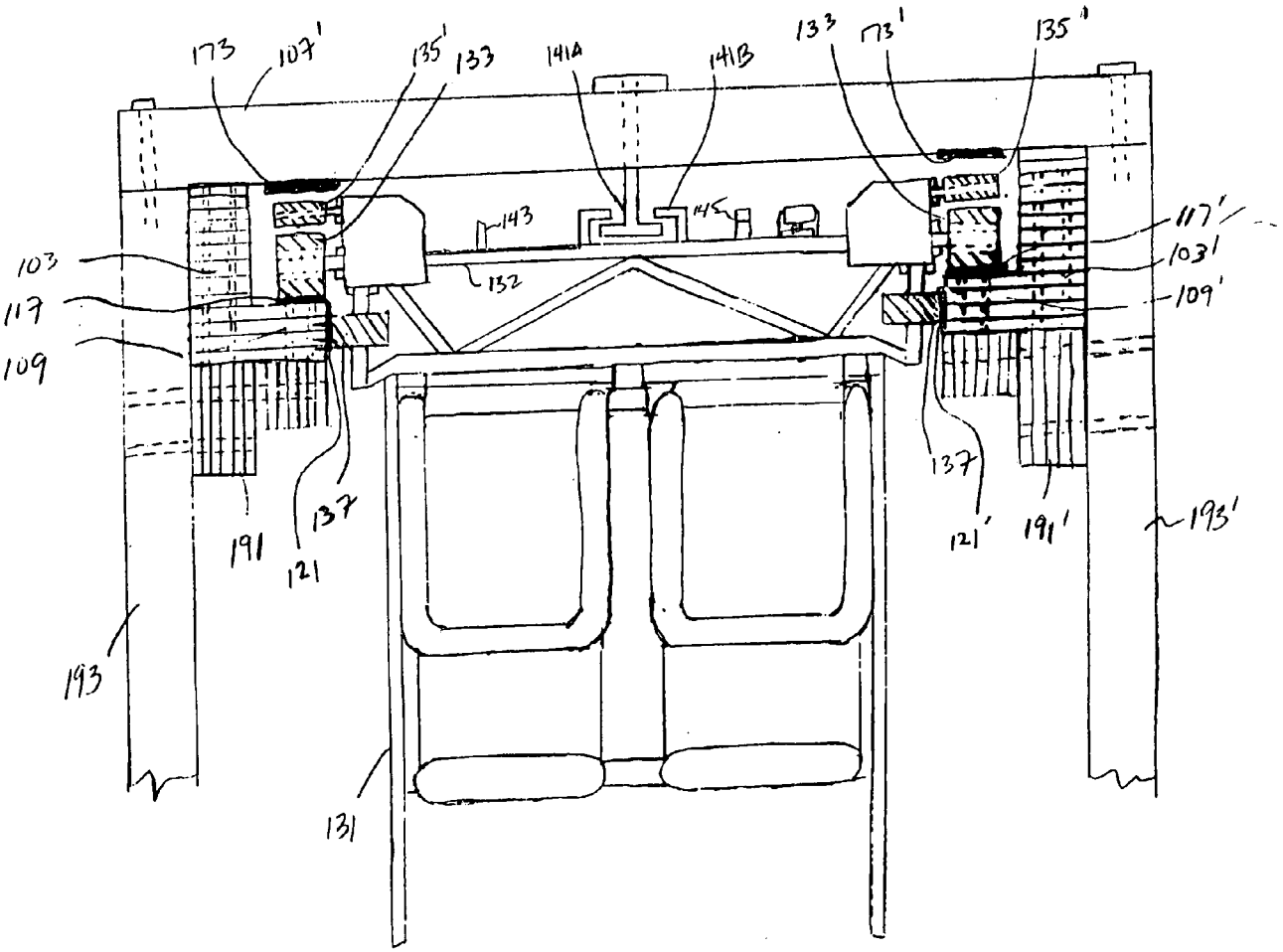
FIG. 5 is a vertical section view through a wooden roller coaster rail with a passenger car riding thereon in accordance with another embodiment of the present invention.

Turning now to FIG. 5 there is shown an alternate embodiment of the present invention which is similar in many respects to the roller coaster described above with respect to FIG. 4; however, the running rail structures 103, 103' are supported by staircase supports 191, 191' that extend in a longitudinal direction (which is perpendicular to the page in FIG. 5) and are affixed to vertical support beams 193, 193' preferably by bolts that pass laterally through the respective staircase supports 191/191' and the corresponding vertical support 193/193'. The staircase supports 191/191' are preferably realized by a plurality of longitudinal timber sections. The staircase supports 191, 191' resist deflection of the rail support portions 109, 109' downward under loading conditions. The vertical support beams 193, 193' extend along the outer surface of the running rail structures to the support tie 107'. The support tie 107' extends laterally from the top of the two vertical support beams 173, 173' such that they rest one and bridge the two support beams as shown. This configuration advantageously provides for quick disassembly and removal of the running rail structures for repair and maintenance purposes.

The layout of the running rail structure of the present invention as described above is extended longitudinally (with deviations to realize curves) to form a circuit of varied elevation. In this manner, the running rail structure of the present invention as described herein is supported by a sequence of lateral support ties that are disposed over and bridge the running rail structure at spaced apart points along the circuit. Preferably, the circuit is substantially closed and begins with a gradient that enables the coaster cars to gain the height (and kinetic energy) necessary for completing the circuit. Following this gradient is typically a nose dive and bank curves as well as other maneuvers. Such maneuvers give rise to a free-fall feeling, strong acceleration, strong compression.

Advantageously, the wooden rail structure and coaster car design of the present invention provides a distinctive rough, noisy out of control feeling to the passenger, which is enjoyed by many roller coaster enthusiasts. It also provides for suspension of the coaster car below the track, which affords a distinctive feeling of freedom (and risk/danger) that is also enjoyed by many roller coaster enthusiasts. These features together provide an "extreme" experience to the passenger that the prior art designs do not offer.

In order to maintain the wooden rail structure, catwalks can be constructed outside the framework of the wooden rail structure in a manner that allows service personnel (e.g., mechanics or carpenters) to walk alongside the wooden rail structure. Such service personnel can also traverse the wooden track structure in a motorized car that is supported by the wooden track structure such that personnel can inspect and fix the wooden track structure while riding on the motorized car.

There have been described and illustrated herein several embodiments of a wooden track roller coaster with a coaster car having seats suspended below the wooden track. While particular embodiments of the invention have been described, it is not intended that the invention be limited thereto, as it is intended that the invention be as broad in scope as the art will allow and that the specification be read likewise. Thus, while particular support structures and car structures have been disclosed, it will be appreciated that other support structures can be used as well. In addition, while particular types of material and construction methods have been disclosed, it will be understood that other materials and construction methods can be used. For example, and not by way of limitation, straps or other fastening mechanisms may be used to join the members of the wooden track together and/or join the wooden track to the support structure. Moreover, the frame structure and wheel structure of the coaster car may be varied. For example, the coupling (and suspension) of the wheels to the frame can be accomplished by a wide variety of designs with different flexion characteristics. In another example, the seat(s) of the coaster car may be suspended from the frame in a flexible (e.g., pendulum manner). In still yet another example, the coaster cars may be coupled together (and/or modified) to form a train of cars. Furthermore, while particular configurations have been disclosed in reference to the support structure for the wooden track, it will be appreciated that other configurations could be used as well. It will therefore be appreciated by those skilled in the art that yet other modifications could be made to the provided invention without deviating from its spirit and scope as claimed.

What is claimed is:

1. A rail for a ride comprising:

a first wooden running track structure including a plurality of layers of individual wooden members;

a second wooden running track structure parallel to said first wooden running track structure and including a plurality of layers of individual wooden members, said first and second running track structures being supported by separate vertical support members; and a plurality of support beams each disposed above and adjacent to said first and second wooden running track structures, said support beams bridging said first and second running track structures;

wherein said first and second wooden running track structure forms a circuit of varied elevation, and said plurality of support beams are spaced apart at points along said circuit.

2. A rail for a ride according to claim 1, wherein:

said circuit is substantially closed.

3. A rail for a ride according to claim 1, wherein:

said first and second wooden running track structures each include at least one metal strip affixed to a surface formed by at least one wooden member.

4. A rail for a ride according to claim 1, wherein:

certain of said plurality of wooden members that form said first and second wooden running track structures are adapted to provide rail support portions that project laterally toward one another, said support portions disposed below said support beams.

5. A rail for a ride according to claim 4, further comprising:

at least one first support member that is disposed under a first of said rail support portions and affixed to a first vertical support beam, said at least one first support member resisting deflection of said first rail support portion downward under loading conditions; and at least one second support member that is disposed under a second of said rail support portions and affixed to a second vertical support beam, said at least one first support member resisting deflection of said second rail support portion downward under loading conditions.

6. A rail for a ride according to claim 5, wherein:

said at least one first support member and said at least one second support member each include a plurality of members arranged in a staircase pattern.

7. A rail for a ride according to claim 4, further comprising:

a first pair of flat metal strips disposed facing one another above a first rail support portion, one affixed to a top surface of said first rail support portion and the other affixed to a first support surface under said support beam; and a second pair of flat metal strips disposed facing one another above a second rail support portion, one affixed to a top surface of said second rail support portion and the other affixed to a second support surface under said support beam.

8. A rail for a ride according to claim 1, wherein:

said first and second running track structures rest on said vertical support members such that said first and second running track structures are disposed between said vertical support members and said support beams.

9. A rail for a ride according to claim 1, wherein:

said support beams rest on said vertical support members, and said first and second running track structures run parallel and adjacent to said vertical support members.

10. A rail for a ride according to claim 1, wherein:

said vertical support members are part of a lattice support structure.

11. A rail for a ride according to claim 10, wherein:

said lattice support structure includes wooden beams.

12. A rail for a ride according to claim 10, wherein:

said vertical support members are part of an elevated frame-tunnel that partially surrounds passengers on all sides.

13. An amusement ride comprising:

a first wooden running track structure including a plurality of layers of individual wooden members;

a second wooden running track structure parallel to said first wooden running track structure and including a plurality of layers of individual wooden members;

a support structure that supports said first and second wooden running track structures; and a passenger carrier having a frame structure with a first set of wheels mounted thereto that run along said first and second wooden running track structures during positive-g motion, a second set of wheels mounted to said frame structure, and at least one seat that is suspended below said first set and second set of wheels.

14. An amusement ride according to claim 13, wherein:

said first and second wooden running track structures form a substantially closed circuit of varied elevation.

15. An amusement ride according to claim 13, wherein:

said first set of wheels has an axis of rotation, and an axis through said plurality of layers of said first wooden running track structure is perpendicular to said axis of rotation.

16. An amusement ride according to claim 13, wherein:

said first and second wooden running track structures each include a first metal strip affixed to a surface formed by at least one wooden member, wherein said first set of wheels run along said first metal strip during positive-g motion.

17. An amusement ride according to claim 16, wherein:

said second set of wheels prevent the passenger carrier from rising completely off said first and second wooden running track structures during negative-g motion.

18. An amusement ride according to claim 17, wherein:

said first and second wooden running track structures each include first and second metal strips affixed to surfaces formed by said wooden members, wherein said first set of wheels run along said first metal strip during positive-g motion, and wherein said second set of wheels run along said second metal strip during negative-g motion in order to prevent the passenger carrier from rising completely off said first and second wooden running track structures during such negative-g motion.

19. An amusement ride according to claim 13, wherein:

said frame structure includes a third set of wheels, said first and second wooden running track structures each include metal strips affixed to surfaces formed by said wooden members, wherein said third set of wheels run along said metal strips to guide lateral motion of the passenger carrier.

20. An amusement ride according to claim 13, wherein:

said passenger carrier includes at least one of a brake fin, a chain-dog and an anti-rollback mechanism affixed to said frame structure above said first set of wheels.

21. An amusement ride, comprising:

a first wooden running track structure including a plurality of layers of individual wooden members;

a second wooden running track structure parallel to said first wooden running track structure and including a plurality of layers of individual wooden members, said first and second running track structures being supported by separate vertical support members;

a support structure that supports said first and second wooden running track structures; and a passenger carrier having a frame structure with a first set of wheels mounted thereto that run along said first and second wooden running track structures during positive-g motion and at least one seat that is suspended below said first set of wheels, wherein said support structure includes a plurality of support beams each disposed above and adjacent to said first and second wooden running track structures, said support beams bridging said first and second running track structures and spaced apart along said circuit.

22. An amusement ride according to claim 21, wherein:

certain of said individual wooden members that form said first and second wooden running track structures are adapted to provide rail support portions that project laterally toward one another, said rail support portions disposed below said support beams.

23. An amusement ride according to claim 21, wherein:

said first and second running track structures rest on said vertical support members such that said first and second running track structures are disposed between said vertical support members and said support beam.

24. An amusement ride according to claim 23, wherein:

said support beams rest on said vertical support members, and said first and second running track structures run parallel and adjacent to said vertical support members.

25. An amusement ride according to claim 21, wherein:

said vertical support members are part of a lattice support structure.

26. An amusement ride according to claim 25, wherein:

said lattice support structure includes wooden beams.

27. An amusement ride according to claim 25, wherein:

said vertical support members are part of an elevated frame-tunnel that partially surrounds passengers on all sides.

28. An amusement ride according to claim 21, further comprising:

at least one first support member that is disposed under a first of said rail support portions and affixed to a first vertical support beam, said at least one first support member resisting deflection of said first rail support portion downward under loading conditions; and at least one second support member that is disposed under a second of said rail support portions and affixed to a second vertical support beam, said at least one first support member resisting deflection of said second rail support portion downward under loading conditions.

29. An amusement ride according to claim 28, wherein:

said at least one first support member and said at least one second support member each include a plurality of members arranged in a staircase pattern.

30. An amusement ride according to claim 22, further comprising:

a first pair of flat metal strips disposed facing one another above a first rail support portion, one affixed to a top surface of said first rail support portion and the other affixed to a first support surface under said support beam;

a second pair of flat metal strips disposed facing one another above a second rail support portion, one affixed to a top surface of said second rail support portion and the other affixed to a second support surface under said support beam; and a second set of wheels mounted to passenger carrier in a position above said first set of wheels, wherein said first set of wheels run along said first pair of metal strips during positive-g motion, and wherein said second set of wheels run along said second pair of metal strips during negative-g motion to prevent the passenger carrier from rising completely off said first and second wooden running track structures during such negative-g motion.

* * * * *